US005182916A

United States Patent [19]

Oike et al.

[11] Patent Number: 5,182,916

[45] Date of Patent: Feb. 2, 1993

[54] AUTOMATIC ICE MAKER AND HOUSEHOLD REFRIGERATOR EQUIPPED THEREWITH

[75] Inventors: Hiroshi Oike, Osaka; Akira Kawamoto, Ibaraki, both of Japan

[73] Assignee: Kabushiki Kaisha Toshiba, Kawasaki, Japan

[21] Appl. No.: 612,980

[22] Filed: Nov. 15, 1990

[30] Foreign Application Priority Data

Nov. 16, 1989 [JP] Japan ..... 1-299217

[51] Int. Cl.[5] ..... F25C 5/06

[52] U.S. Cl. ..... 62/135; 62/353

[58] Field of Search ..... 62/72, 135, 353

[56] References Cited

U.S. PATENT DOCUMENTS 3,206,940 9/1965 Archer ..... 62/135
3,224,213 12/1965 Hoyt, Jr. ..... 62/340 X
3,318,105 5/1967 Burroughs et al. ..... 62/351 X
4,142,377 3/1979 Fogt ..... 62/135
4,727,720 3/1988 Wermicki ..... 62/353 X
4,852,359 8/1989 Mazzotti ..... 62/353 X
4,909,039 3/1990 Yamada et al. ..... 62/66

*Primary Examiner*—William E. Tapolcai
*Attorney, Agent, or Firm*—Cushman, Darby & Cushman

[57] ABSTRACT

An automatic ice maker includes an ice tray supplied with water, which water is made into ice. The ice tray is inverted after the ice making so that ice cubes are removed from the ice tray. An outlet is directed to the underside of the ice tray so that the chilled air from the outlet flows along the underside of the ice tray. As a result, the water at the bottom side of the ice tray is first made into ice, thereby providing opaque ice cubes. A thermistor for determining completion of the ice making senses the temperature of the upper portion of the ice tray where the water is last made into ice.

6 Claims, 5 Drawing Sheets

AUTOMATIC ICE MAKER AND HOUSEHOLD REFRIGERATOR EQUIPPED THEREWITH

BACKGROUND OF THE INVENTION

This invention relates to automatic ice maker which automatically provides transparent ice cubes and a household refrigerator equipped therewith.

In household refrigerators equipped with automatic ice makers, the automatic ice maker comprises an ice tray provided in an ice making compartment. Water is supplied into the ice tray by pump means and the water in the ice tray is made into ice. When the temperature of the ice tray sensed by a temperature sensor mounted on the ice tray reaches a predetermined ice making completion temperature, a drive mechanism is operated to invert the ice tray containing ice so that ice cubes are removed from the ice tray, thereby reserving the ice cubes in an ice reserving box. Subsequently, water is re-supplied into the ice tray and made into ice. Such an ice making operation is reiteratively performed.

In the above-described ice making manner, the chilled air contacts every side of the ice tray nearly uniformly and accordingly, the water is frozen nearly uniformly over the whole. Consequently, air bubbles are often left in the ice cubes and render the ice cubes opaque. An ice maker which supplies transparent ice cubes have been desired.

SUMMARY OF THE INVENTION

Therefore, an object of the present invention is to provide an automatic ice maker which can provided transparent ice cubes and can improve the accuracy in sensing the temperature of the ice tray by a temperature sensor and a household refrigerator equipped with the above-mentioned automatic ice maker.

The present invention provides an ice maker comprising an ice making compartment, an ice tray provided in the ice making compartment so as to be inverted, a drive mechanism for driving the ice tray so that it is inverted, water supply means for supplying the ice tray with water, chilled air supply means having an outlet directed to the underside of the ice tray in the ice making compartment, the chilled air supply means supplying the chilled air into the ice making compartment through the outlet so that the chilled air flows along the underside of the ice tray and the water in the ice tray is frozen first from the bottom side of the ice tray, a temperature sensor provided so as to sense the temperature of the upper portion of the ice tray, and control means for controlling the drive mechanism to invert the ice tray when the temperature sensed by the temperature sensor reaches an ice making completion temperature, the ice being removed from the ice tray thereby.

Since the chilled air supplied into the ice making compartment through the outlet flows along the underside of the ice tray, the water at the bottom side of the ice tray is first made into ice and the water at the water surface side thereof is last made into ice. Consequently, air bubbles contained in the water are allowed to promptly escape from the water surface side and accordingly, transparent ice from which the air bubbles have been excluded may be obtained. Furthermore, since the temperature sensor for sensing the ice making completion temperature is provided at the upper portion of the ice tray, it senses the temperature of a portion of the ice tray where the water is last made into ice.

Consequently, the ice making completion completion temperature can be accurately sensed.

Vibration applying means may be provided for vibrating the ice tray in an ice making operation. Air bubbles contained in the water in the ice tray is caused to promptly escape therefrom before the water surface side is frozen.

Alarming means may also be provided for alarming in occurrence of a water supply failure. In this case, the control means may activate the alarming means when the temperature sensed by the temperature sensor at the end of a water supply operation by the water supply means is lower than a predetermined temperature. Consequently, a user can find the water supply failure quickly.

Furthermore, position detecting means may be provided for detecting both of horizontal and inversion positions of the ice tray. The position detecting means generates a signal when detecting each of the horizontal and inversion positions occupied by the ice tray. In this case, the control means may activates the drive mechanism in accordance with the detection signals so that the ice tray is stopped at the horizontal and inversion positions. Consequently, the ice tray can be stopped at both positions reliably.

Furthermore, an ice reserving box may be provided for containing ice having fallen from the ice tray and reserved ice detecting means may be provided for detecting an amount of the ice reserved in the ice reserving box. In this case, the control means may interrupt the ice making operation while the reserved ice detecting means is determining that the ice reserving box is filled full with ice. Consequently, an unnecessary amount of ice can be prevented from being made and ice can be prevented from overflowing the ice reserving box.

It is preferable that the temperature sensor comprise a thermistor molded out of an insulation resin. In this case, the cost of the temperature sensor can be reduced and the waterproof thereof can be improved.

The ice maker may further comprise a cover covering the upper side of the ice tray during the ice making stage so that the chilled air is prevented from contacting the water surface in the ice tray. Consequently, the ice making at the water surface side may be retarded with more reliability.

Additionally, the ice maker may further comprise a heater applying heat to the upper side of the ice tray during the ice making stage. Preferably, the heater may be disposed inside the cover covering the upper side of the ice tray.

When the above-described ice maker is incorporated in a household refrigerator, transparent ice cubes can be made at home with ease.

A method of making ice in accordance with the present invention comprises steps of supplying an ice tray with water, feeding chilled air so that the chilled air flows along a bottom surface of the ice tray such that the water at the bottom side of the ice tray is first frozen into ice, sensing the temperature of an upper portion of the ice tray during an ice making operation to thereby determine whether or not the temperature sensed has reached an ice making completion temperature, and inverting the ice tray when the temperature of the upper portion of the ice tray is decreased to the ice making completion temperature, thereby removing ice from the ice tray.

Other objects of the present invention will become obvious upon understanding of an illustrative embodiment about to be described or will be indicated in the appended claims. Various advantages not referred to herein will occur to one skilled in the art upon employment of the invention in practice.

DESCRIPTION OF THE PREFERRED EMBODIMENT

An embodiment of the present invention will now be described with reference to FIGS. 1 to 7 of the accompanying drawings.

Figure 2:
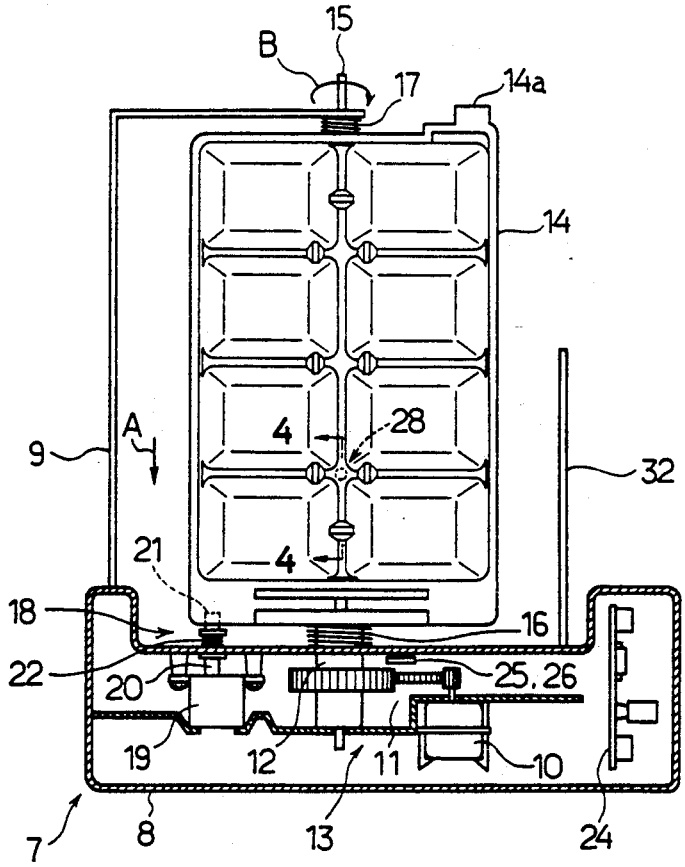
FIG. 2 is a transverse sectional view of the ice maker.

Referring first to FIG. 2, a refrigerator cabinet 1 has therein a freezing compartment 2, a storage compartment 3 and an ice making compartment 4. Air chilled by an evaporator 5 is supplied to the compartments 2, 3, 4 by a fan 6. An automatic ice maker 7 in accordance with the present invention is provided in the ice making compartment 4. The automatic ice maker 7 will be described in detail below.

A generally rectangular box-shaped frame 8 is provided in the upper front interior of the ice making compartment 4. A generally L-shaped support member 9 is provided on an end of the rear of the frame 8 so as to extend rearwardly, as is shown in FIG. 2. A drive mechanism 13 comprising an electric motor 10, a reduction gear mechanism 11 and an output shaft 12 is provided in the frame 8. Rotation of the electric motor 10 is suitably reduced by the reduction gear mechanism 11 and then, transmitted to the output shaft 12. An ice tray 14 is formed of a plastic material, for example. The ice tray 14 has an upper opening and is formed into the shape of a thin rectangular box. The interior of the ice tray 14 is divided into a plurality of small compartments by partitions so that the corresponding number of ice cubes are provided. The ice tray 14 is supported by the output shaft 12 at the central front and by the support member 9 via a support shaft 15 at the central rear so that the ice tray 14 is moved in the directions of and rotatively moved about the shafts 12 and 15. A compression coil spring 16 is provided between the frame 8 and the ice tray 14 through the output shaft 12. Another compression coil spring 17 is provided between the ice tray 14 and the support member 9 through the support shaft 15. The ice tray 14 has a convex portion 14*a* formed on an rear end thereof. The convex portion 14*a* is engaged with the support member 9 when the ice tray 14 is rotatively moved so as to be inverted, thereby limiting the rotative movement of the ice tray 14.

Figure 3:
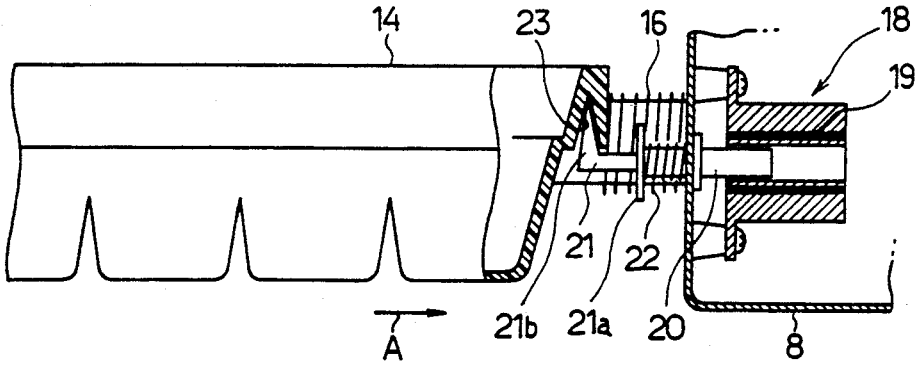
FIG. 3 is a longitudinal sectional side view of a vibration applying mechanism.

Reference numeral 18 designates a vibration applying mechanism as vibration applying means for vibrating the ice tray 14 so that it is moved in the directions of the shafts 12 and 15. The vibration applying mechanism 18 comprises an electromagnet 19 provided between the output shaft 12 and the support member 9 in the frame 8, a plunger 20 movably inserted in the electromagnet 19, a vibration transmission member 21 threadably engaged with an end of the plunger 20, and a compression coil spring 22 provided between a flange 21*a* of the vibration transmission member 21 and the rear wall of the frame 8, as shown in FIG. 3. A distal engaging portion 21*b* of the vibration transmission member 21 disengageably engaged, from below, with a generally V-shaped engaged portion 23 formed in the ice tray 14. Upon energization of the electromagnet 19, the plunger 20 is attracted against the compression coil spring 22 in the direction of an arrow A. With this movement of the plunger 20, the ice tray 14 is moved through the vibration transmission member 21 in the same direction as the plunger 20 is attracted. When the electromagnet 19 is deenergized, the compression coil spring 22 forces the plunger 20, the vibration transmission member 21 and the ice tray 14 to move together in the direction opposite the arrow A. These movements are reiteratively performed, thereby axially vibrating the ice tray 14.

Figure 4:
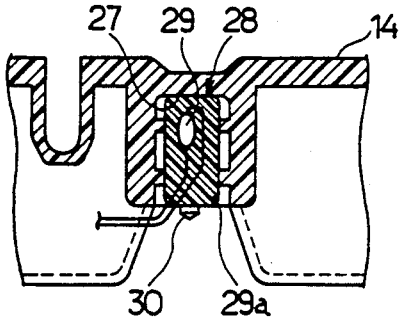
FIG. 4 is an enlarged longitudinal sectional view of the portion of an ice tray where a temperature sensor is mounted.

In the frame 8 are provided a circuit board 24, a horizontal position detecting switch 25 provided in the vicinity of the output shaft 12 for detecting the horizontal position of the ice tray 14, and an inverted ice tray position detecting switch 26 for detecting the position of the ice tray 14 inverted. Each of these switches comprises, for example, a conventional proximity switch or photoelectric switch. An approximately circular recess 27 is formed in a predetermined portion of the ice tray 14, as shown in FIG. 4. The recess 27 has an open underside. Reference numeral 28 designates a cylindrical temperature sensor comprising a thermistor 29 molded out of a molding material 29*a*. The temperature sensor 28 is inserted in the recess 27 such that the thermistor 29 is positioned at the upper side, and secured by an engagement claw 30 formed on the ice tray 14. The temperature sensor 28 is provided for sensing the temperature of the upper side of the ice tray 14.

Figure 1:
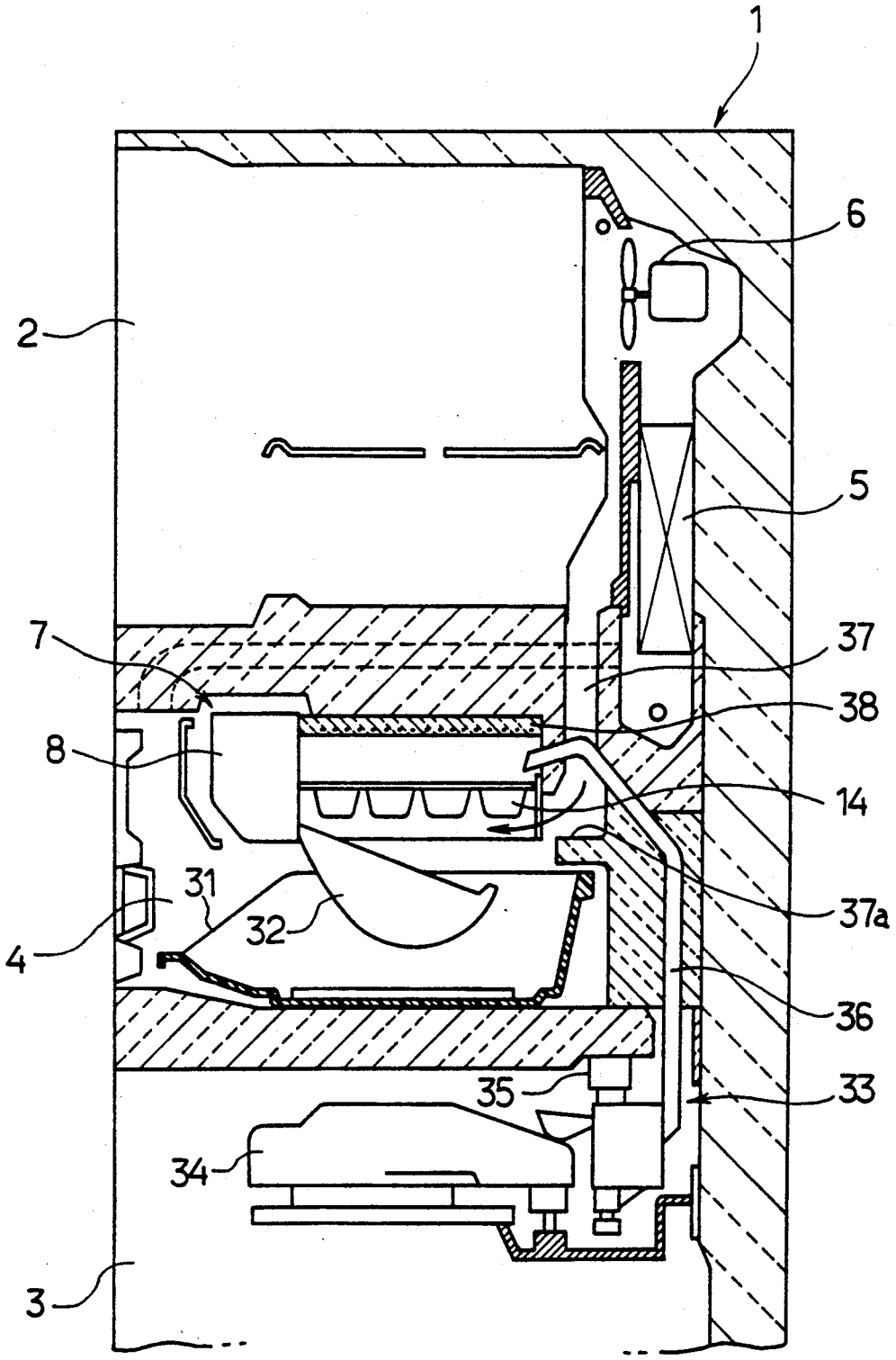
FIG. 1 is a partially longitudinal sectional side view of a refrigerator provided with an ice maker of an embodiment of the invention.

Referring to FIG. 1, an ice reserving box 31 is drawably provided below the ice tray 14 in the ice making compartment 4. A reserved ice detecting lever 32 is rotatively mounted on the frame 8. Reference numeral 33 designates water supply means 33 for supplying the ice tray 14 with water reserved in a water-supply tank 34 contained in the storage compartment 3 by way of a water-supply pump 35 through a water-supply pipe 36. A distal end of the water-supply pipe 36 faces the ice tray 14. A chilled air supply port 37*a* of a chilled air duct 37 supplying the chilled air to the ice making compartment 4 is directed to the underside of the ice tray 14 so that the chilled air is mainly caused to flow along the underside of the ice tray 14. Thus, chilled air supply means is composed of the chilled air duct 37, the evaporator 5 and the fan 6.

Figure 5:
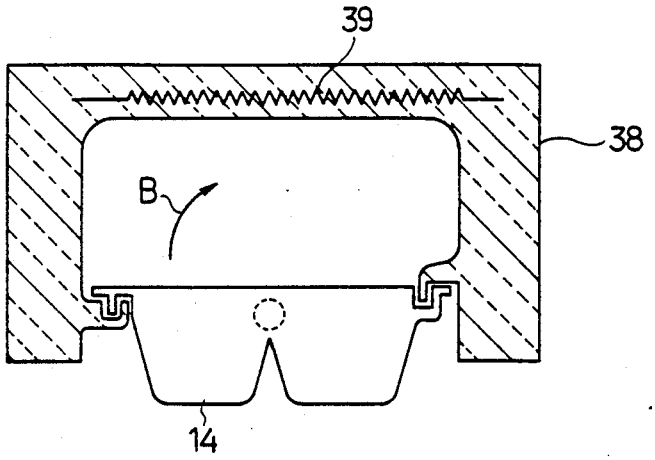
FIG. 5 is a longitudinal sectional view of a heat insulation cover.

A heat insulation cover 38 formed from a heat insulation material is provided in the ice making compartment 4 for covering the upper side of the ice tray 14. A heater 39 is provided on the upper portion of the heat insulation cover 38 as shown in FIG. 5. The heat insulation cover 38 constructed so as to allow the ice tray 14 to be moved in the directions of and rotatively moved about the shafts 12 and 15.

Figure 6:
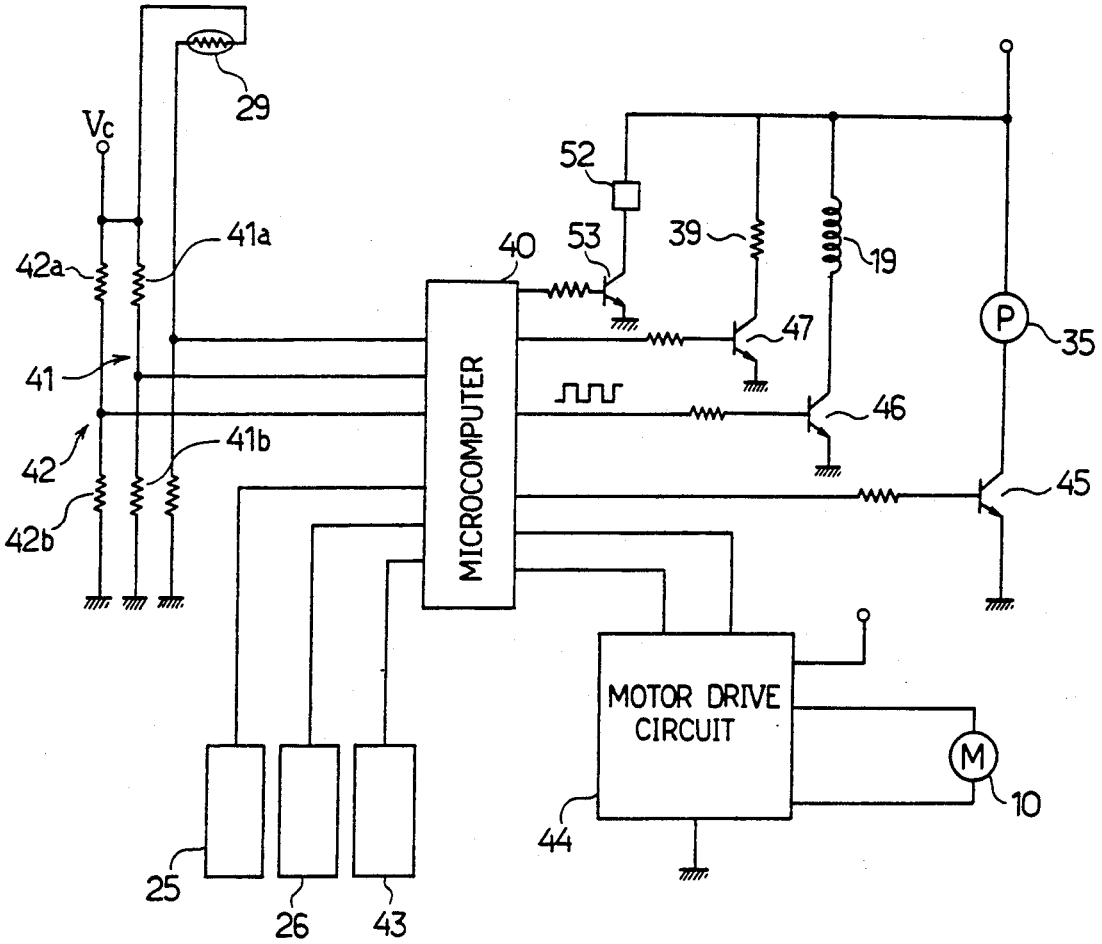
FIG. 6 is an electric circuit diagram of the ice maker.

FIG. 6 shows an electric circuit of the automatic ice maker 7. A microcomputer 40 is provided for controlling stages for the ice making as will be described below. The microcomputer 40 is supplied with a voltage signal representative of the temperature of the ice tray 14 sensed by the thermistor 29, a reference voltage generated by a first reference voltage generating circuit 41 so as to be representative of a water-supply completion temperature of the ice tray 14 (−9.5° C., for example), and a second reference voltage generated by a second reference voltage generating circuit 42 so as to be representative of an ice-making completion temperature of the ice tray 14 (−12.0° C., for example). The first reference voltage generating circuit 41 comprises two resistances 41*a* and 41*b* series connected between a power-supply terminal and a ground terminal and similarly, the second reference voltage generating circuit 42 comprises two resistances 42*a* and 42*b* series connected between the power-supply terminal and a ground terminal. Detection signals are supplied to the microcomputer 40 from the horizontal position detecting switch 25, the inverted ice tray position detecting switch 26 and the reserved ice detecting switch 43 responsive to a reserved ice detecting lever 32. Furthermore, the motor 10 is connected to the microcomputer 40 through a motor drive circuit 44. The water supply pump 35, the electromagnet 19, the heater 39 and alarming means 52 comprised of a light-emitting element or buzzer for alarming in occurrence of a water supply failure are also connected to the microcomputer 40 through transistors 45, 46, 47, 53, respectively. The motor 10, the water supply pump 35, the electromagnet 19, the heater 39 and the alarming means 52 will be controlled by the microcomputer 40 in the manner as will be described later.

Figure 7:
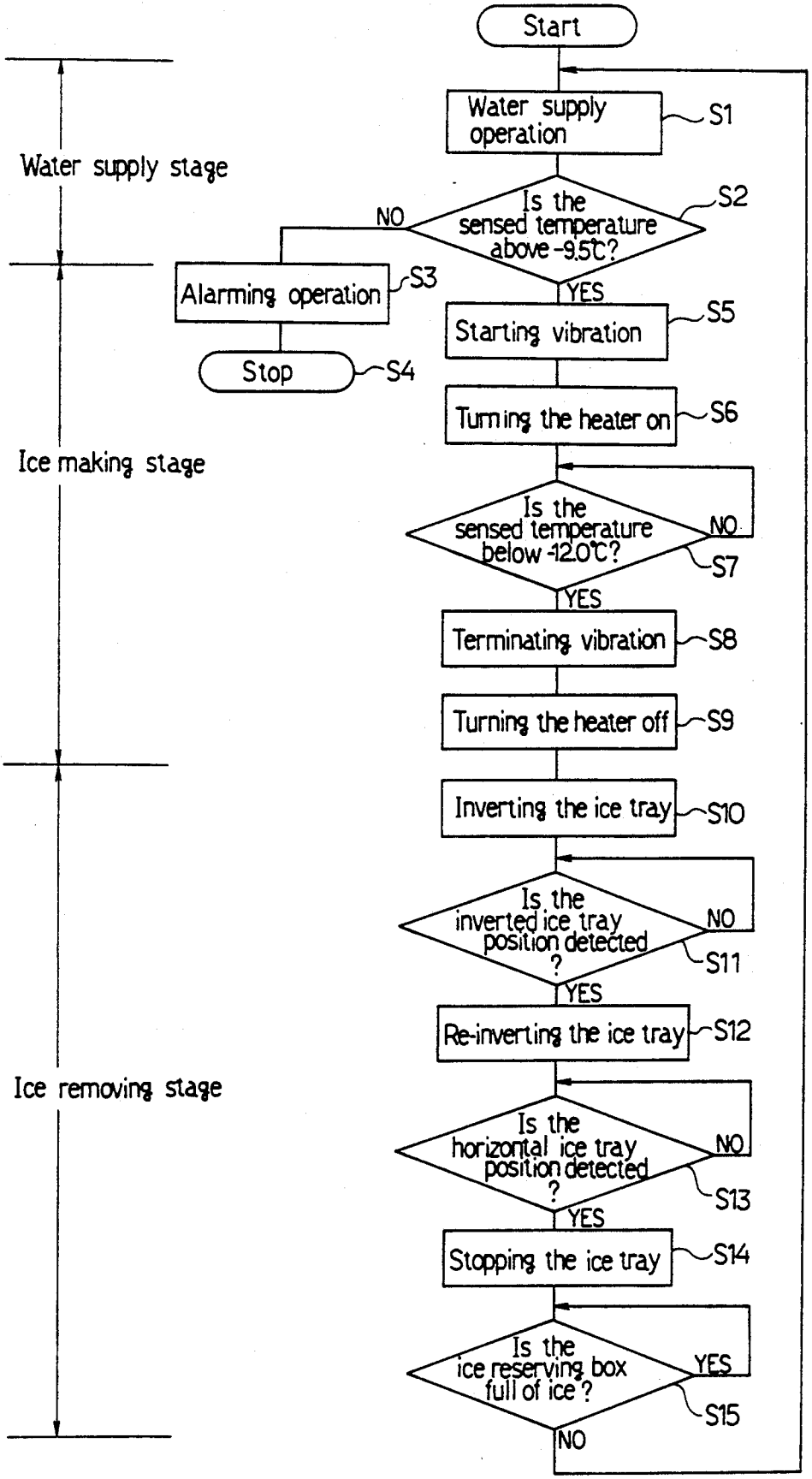
FIG. 7 is a flowchart for explaining the control manner of control means.

The operation of the ice maker thus constructed will now be described with reference to the flowchart of FIG. 7 showing the control manner of the microcomputer 40.

In a water supply stage, the water supply pump 35 is driven for a predetermined period of time through the transistor 45 at a step S1, thereby supplying water to the ice tray 14. At a step S2, the voltage signal representative of the temperature sensed by the thermistor 29 of the temperature sensor 28 is compared with the reference voltage from the first reference voltage generating circuit 41 so that it is determined whether or not the water supply has been completed. More specifically, when the temperature sensed by the temperature sensor 28 is lower than the water supply completion temperature (−9.5° C.), it is determined that the water has not been supplied to the ice tray 14 for the reason, for example, that no water is reserved in the water supply tank 34. In this case, the alarming means 52 is operated to perform an alarming operation at a step S3 and the water supply operation is interrupted at a step S4. On the other hand, when the temperature sensed by the temperature sensor 28 is higher than the water supply completion temperature, it is determined that the water supply has been completed, and an ice making stage is initiated.

In the ice making stage, the microcomputer 40 delivers a voltage signal with a waveform as shown in FIG. 6, to the transistor 46 at a step S5. With this, the electromagnet 19 is controlled through the transistor 46 so as to be energized and deenergized and the ice tray 14 is vibrated in the directions of the shafts 12 and 15 or in the directions of the arrow A and opposite the arrow A by the vibration applying mechanism 18. At a step S6, the heater 39 is energized through the transistor 47. The chilled air from the outlet 37*a* is mainly directed to the underside of the ice tray 14 and the water is vibrated with vibration of the ice tray 14. Additionally, the water surface side is heated by the heater 39. Consequently, the ice making is retarded at the water surface side and the ice making is first initiated at the bottom side of the ice tray 14, progressing to the water surface side. As a result, air bubbles contained in the water may be caused to escape therefrom, thereby making the transparent ice cubes.

The voltage signal representative of the temperature sensed by the thermistor 29 of the temperature sensor 28 is compared with the second reference voltage from the second reference voltage generating circuit 42 for determination of the completion of the ice making stage, at a step S7 so that it is determined whether or not the ice making has been completed. It is determined that the ice making has been completed when the temperature sensed by the temperature sensor 28 is lower than the ice making completion temperature (−12.0° C.), thereby deenergizing the electromagnet 19 to terminate vibration of the ice tray 14 at a step S8. Then, the heater 39 is deenergized at a step S9 and the microcomputer 40 advances to an ice removing operation. In this case, since the temperature sensor 28 senses the temperature of the upper side of the ice tray 14 where the water is last made into ice, the completion of the ice making stage may be detected with more reliability.

The motor 10 is energized through the motor drive circuit 44 to be driven at a step S10 and consequently, the ice tray 14 is rotatively moved in the direction of the arrow B in FIG. 2 by the drive mechanism 13, thereby inverting the ice tray 14. When the convex portion 14*a* of the ice tray 14 is engaged with the support member 9, the ice tray 14 is twisted such that the ice cubes fall out into the ice reserving box 31, thus executing the ice removing stage. In this regard, the engaged portion 23 of the ice tray 14 is disengaged from the engaging portion 21*b* of the vibration transmission member 21 with the rotative movement of the ice tray 14. When the position of the ice tray 14 inverted is detected by the inverted ice tray position detecting switch 26 at a step S11, the microcomputer advances to a step S12. The motor 10 is driven so as to be rotated in the direction opposite that in inverting the ice tray 14, thereby turning the ice tray 14 in the direction opposite the arrow B at the step S12. When the former horizontal position of the ice tray 14 is detected by the horizontal position detecting switch 25 at a step S13, the motor 10 is deenergized to terminate rotation of the ice tray 14, thereby returning the ice tray 14 to the former position, at a step S14. In this case, the engaged portion 23 of the ice tray 14 is re-engaged with the engaging portion 21*b* of the vibration transmission member 21. At a step S15, it is determined by the reserved ice detecting switch 43 whether or not the ice reserving box 31 is filled full with the ice cubes. When it is determined that the ice reserving box 31 is not filled full with the ice, the microcomputer 40 returns to the step S1. On the other hand, when it is determined that the ice reserving box 31 is full of the ice cubes, the microcomputer 40 is on standby.

In accordance with the above-described embodiment, since the chilled air is caused to mainly flow from the outlet 37*a* along the underside of the ice tray 14, the water at the bottom side of the ice tray 14 is first made into ice and consequently, the transparent ice not containing air bubbles may be made. Furthermore, the temperature sensor 28 sensing the ice making completion temperature is provided at the upper side of the ice tray 14 where the water is last made into ice. Consequently, the completion of the ice making stage may be accurately detected and the ice removing operation may be prevented from starting before the water surface in the ice tray 14 is frozen. Furthermore, the water which is not made into ice can be prevented from flowing out of the ice tray 14 into the ice reserving box 31 during the ice making stage.

Since the ice tray 14 is vibrated during the ice making stage, the ice making is retarded at the water surface side. Consequently, transparent ice cubes can be made with more reliability.

Furthermore, alarming means 52 is provided for alarming in the occurrence of the water supply failure. When the temperature sensed by the temperature sensor 28 at the time of completion of the water supply stage is below the predetermined temperature, the alarming means 52 is operated to alarm for the water supply failure. Consequently, the user can quickly find the occurrence of the water supply failure.

Furthermore, the position detecting switches 25, 26 are provided for detecting both of the horizontal and inversion positions of the ice tray 14, respectively. Based on the output signals from the position detecting switches 25, 26, the inverting operation of the ice tray 14 is stopped at the horizontal and inversion positions. Thus, the ice tray 14 may be stopped at each of the positions exactly and accordingly, the reliability of the inverting operation may be improved. Alternatively, instead of the position detecting switches 25, 26, the motor 10 of the drive mechanism 13 may be controlled by a timer so that the ice tray 14 is stopped at both of the horizontal and inversion positions.

The reserved ice detecting switch 43 is provided for detecting the ice cubes reserved in the ice reserving box 31 to thereby determine whether or not the ice reserving box 31 is filled full with the ice cubes. Since the ice making is interrupted while the ice reserving box 31 is filled full with the ice cubes. Consequently, an unnecessary amount of ice cubes can be prevented from being made and the ice cubes can be prevented from overflowing the ice reserving box 31.

Since the temperature sensor 28 comprises the thermistor 29 molded out of the insulation material 29*a*, the cost of the temperature sensor 28 may be decreased and the waterproof thereof may be improved.

The heat insulation cover 38 is provided for covering the upper side of the ice tray 14 during the ice making stage so that the chilled air is prevented from contacting the water surface in the ice tray 14. Consequently, the ice making at the water surface side can be retarded with more reliability.

When the above-described ice maker 7 is incorporated in household refrigerators, the transparent ice cubes may be made with ease at home.

Figure 8:
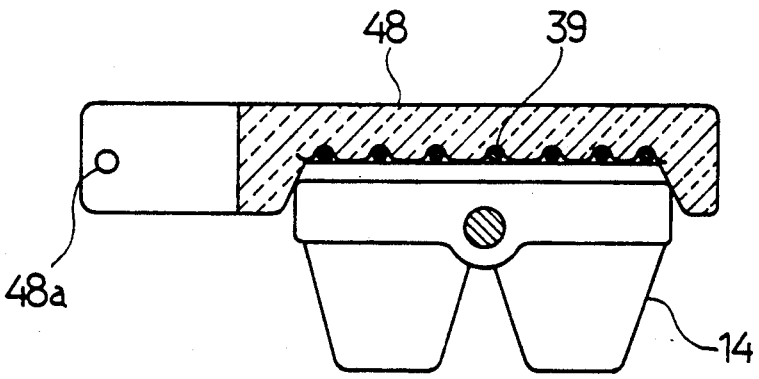
FIG. 8 is a view similar to FIG. 5 illustrating a second embodiment of the invention.

FIG. 8 illustrates a second embodiment of the invention. Although the heat insulation cover 38 is secured to the ice tray 14 in the foregoing embodiment, a heat insulation cover 48 is rotatably supported on the support member 9 through one end shaft portion 48*a* thereof. With rotatable movement of the ice tray 14, the heat insulation cover 48 is rotatably moved about the shaft portion 48*a*.

Figure 9:
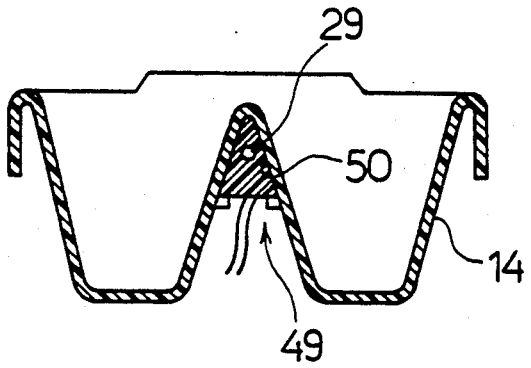
FIG. 9 is a view similar to FIG. 4 illustrating a third embodiment of the invention.
Figure 10:
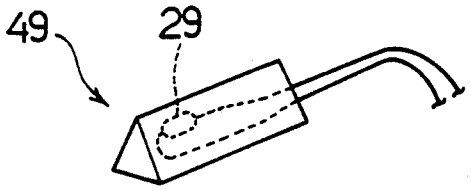
FIG. 10 is a perspective view of a temperature sensor employed in the ice maker of the third embodiment.

FIGS. 9 and 10 illustrate a third embodiment. Although the temperature sensor 28 is cylindrical in the first embodiment, a temperature sensor 49 is formed into a triangle pole in the third embodiment. The thermistor 29 is disposed in the ridge portion of the temperature sensor 49. The temperature sensor 49 is arranged in a V-shaped recessed portion 50 in the underside of the ice tray 14 so that the thermistor 29 is positioned at the upper recessed portion 50, whereby the temperature of the upper portion of the ice tray 14 is sensed by the temperature sensor 49.

The foregoing disclosure and drawings are merely illustrative of the principles of the present invention and are not to be interpreted in a limiting sense. The only limitation is to be determined from the scope of the appended claims.

We claim:

1. An ice maker comprising:

a) an ice making compartment;

b) an ice tray having an underside and an upper side, the ice tray being provided in the ice making compartment so as to be capable of being inverted;

c) a drive mechanism for inverting the ice tray, thereby removing the ice from the ice tray;

d) a cover provided on the upper side of the ice tray;

e) a heater embedded in the cover for heating the upper side of the ice tray during an ice making stage;

f) water supply means for supplying the ice tray with water from a bottom surface of the ice tray to a water surface;

g) chilled air supply means, having an outlet directed to the underside of the ice tray in the ice making compartment, for supplying chilled air into the ice making compartment through the outlet so that the chilled air flows along the underside of the ice tray, the water in the ice tray being frozen first from the bottom side surface of the ice tray such that air bubbles contained in the water are caused to escape therefrom through the water surface, thereby making a transparent ice;

h) a temperature sensor including a thermistor molded in an insulating resin so that the thermistor is embedded in an upper portion of the insulating resin, the temperature sensor being disposed at an intermediate position of the height of the ice tray; and i) control means for controlling the drive mechanism to invert the ice tray when the temperature sensed by the temperature sensor reaches an ice making completion temperature, the ice being removed from the inverted ice tray.

2. An ice maker according to claim 1, which further comprises vibration applying means for vibrating the ice tray in an ice making operation so that air bubbles contained in the water in the ice tray are caused to escape therefrom before the water surface side is frozen.

3. An ice maker according to claim 1, which further comprises alarming means for alarming in occurrence of a water supply failure, the control means activating the alarming means when the temperature sensed by the temperature sensor at the end of a water supply operation by the water supply means is lower than a predetermined temperature.

4. An ice maker according to claim 1, which further comprises position detecting means for detecting both of horizontal and inversion positions of the ice tray, the position detecting means generating a signal when detecting each of the horizontal and inversion positions occupied by the ice tray, the control means activating the drive mechanism in accordance with the detection signals so that the ice tray is stopped at the horizontal and inversion positions.

5. An ice maker according to claim 1, which further comprises an ice reserving box for containing ice having fallen from the ice tray and reserved ice detecting means for detecting an amount of the ice reserved in the ice reserving box, the control means interrupting an ice making operation while the reserved ice detecting means is determining that the ice reserving box is filled full with ice.

6. A household refrigerator equipped with the ice maker in claim 1.

* * * * *